US005638581A

United States Patent [19]

Burke

[11] Patent Number: 5,638,581

[45] Date of Patent: Jun. 17, 1997

[54] BALLOON MOORING SYSTEM

[76] Inventor: Edward Matthew Burke, 17220 W. Eight Mile Rd., Southfield, Mich. 48076

[21] Appl. No.: 575,556

[22] Filed: Dec. 20, 1995

Related U.S. Application Data

[63] Continuation-in-part of Ser. No. 341,745, Apr. 21, 1989, abandoned.

[51] Int. Cl.[6] ..... A44B 18/00; B65D 77/00

[52] U.S. Cl. ..... 24/30.5 R; 24/3.13; 24/306; 24/442; 24/559

[58] Field of Search ..... 24/306, 442, 17 AP, 24/17 A, 17 B, 3.13, 3.1, 300, 303, 16 R, 30.5 R, 30.5 S, 324, 332, 559, 302, 16 PB; 248/205.3

[56] References Cited

U.S. PATENT DOCUMENTS

| | | | |
|---|---|---|---|
| 265,461 | 10/1882 | Sweet | 24/559 |
| 1,797,456 | 3/1931 | Walker | 24/3.13 |
| 2,645,514 | 7/1953 | Mitchko | 24/30.5 P |
| 3,146,778 | 9/1964 | Krawiec | 24/304 |
| 3,365,684 | 1/1968 | Stemke et al. | 24/303 |
| 3,392,729 | 7/1968 | Lenoir | 24/3.13 |
| 3,403,429 | 10/1968 | Smith | 24/442 |
| 4,765,037 | 8/1988 | Perry | 24/3.13 |
| 4,800,594 | 1/1989 | Young | 24/442 |
| 4,835,821 | 6/1989 | Durante | 24/306 |
| 4,862,563 | 9/1989 | Flynn | 24/306 |
| 4,903,698 | 2/1990 | Huber et al. | 24/17 AP |
| 4,936,532 | 6/1990 | Williams | 24/30.5 S |
| 5,008,987 | 4/1991 | Armour, II | 24/442 |
| 5,056,197 | 10/1991 | Cohen | 24/559 |
| 5,301,392 | 4/1994 | Richman | 24/30.5 R |

*Primary Examiner*—Victor N. Sakran
*Attorney, Agent, or Firm*—A. T. Knowles

[57] ABSTRACT

The present invention provides means for quickly and easily attaching a balloon to an anchoring object such as a name card holder, a flag, or a garment. The preferred embodiment is comprised of a specially manufactured ribbon which is made with an attachment mechanism on one end so that the balloon can be secured to an anchoring object without complicated pins, adhesive tape or knots.

6 Claims, 4 Drawing Sheets

BALLOON MOORING SYSTEM

This application is a continuation in part of a prior application for a "BALLOON MOORING SYSTEM", Ser. No. 07/341,745, filed on Apr. 21, 1989, abandoned.

BACKGROUND—FIELD OF INVENTION

This invention relates generally to mooring systems of the type that can be used to anchor or secure a smaller object to a larger, more stable object, and particularly to a mooring system designed for attaching "lighter-than-air" balloons to a relatively fixed object.

BACKGROUND—DESCRIPTION OF PRIOR ART

Helium or lighter-than-air balloons are commonly found in modern society. Their popularity has grown enough recently to spark a new industry—balloon stores. Now in most every major city you can order a "bouquet" of balloons for any occasion from a variety of sources. Releasing thousands of colorful, helium filled balloons has become a common occurrence at large public gatherings and celebrations. There is something magical and exhilarating about such a display. Perhaps this is due in part to a linkage between the traditional use of balloons at festivities and the uncommon sight of seeing an apparently solid object rise up in defiance of the pull of gravity.

Nearly everyone has experienced the phenomena of losing control of a balloon filled with a lighter-than-air gas and watching the balloon float away. The present invention is designed to provide a simple system for attaching a balloon to another object such as a name tag, flag or article of clothing to prevent this from happening.

The most common method of anchoring a helium filled balloon is to tie it with a string or ribbon and then secure the free end of the string or ribbon to a heavy object. Securing the free end of the string is usually accomplished by taping, pinning or tying to an object such as a wrist or piece of furniture, which is a process that takes time and dexterity and can therefore often be frustrating to accomplish.

Herein lies a problem that has yet to be solved. If an easier method could be devised to attach balloons to anchoring objects, it is likely their usage at public occasions would grow dramatically, thereby adding a festive, exciting and fun element of decoration.

Picture a child's birthday party—children love helium balloons and if possible will quickly move to claim one or more as their own—a situation where balloons are soon "lost" and float to the ceiling, if indoors, and if outdoors are really lost. Heretofore, once a child selected his or her personal balloon, they would have to keep a tight grip on the balloon string or get help to have it tied to their wrist or chair. There is currently no easy way to quickly and easily attach a balloon so a child can keep and enjoy his or her balloon for a longer time.

Picture a convention or political rally, with participants roaming about carrying pennants and signs and balloons, all of which can be used to publicize one's group affiliation or message. These are also all great tools to set the mood of a meeting and elevate it above the hum-drum of ordinary affairs. But, the problem with all of these, whether pennant, sign or balloon, is that each has to be hand carried and this can be very restricting at a time when there are frequent hand shakes all around, not to mention the need to carry other items simultaneously. In such a situation, it would be ideal if one could easily anchor a balloon to a hat, sleeve, or name card holder so it didn't have to be hand carried at all times.

SUMMARY OF THE INVENTION

No integrated mechanical fastening system is known to exist which combines a balloon anchoring ribbon with a fastening mechanism and various mooring objects to provide "hands free" use of balloons. There is presently no known mechanism that will allow the balloon consumer or user the flexibility and comfort of being able to frolic and play while enjoying the cheerful ambiance created by the dancing movements of a colorful helium filled balloon. Instead, one is always on guard to keep hold of a floating balloon, because if you let go it flies away, and this can put a damper on an otherwise joyous occasion. Now, the balloon mooring system of the present invention allows children of all ages to enjoy a balloon without stressful worry about whether it could be lost in a moment of inattention.

The present invention provides a means for quickly, easily and securely attaching a balloon to an anchoring or "mooring" object such as a wrist, name card holder, pennant, garment or other object. The preferred embodiment is comprised of a specially manufactured ribbon which is made with an attachment mechanism on one end so that the balloon can be anchored or secured to a variety of mooring objects without complicated knots or combinations with other items such as pins or tape.

The attachment means of the preferred embodiment has a dual closure system: a first closure mechanism which allows for attachment by small children and second, more secure closure mechanism which requires more dexterity to operate and allows the attachment means to function reliably within high stress environments where the invention is subjected to greater forces such as high winds. The first closure mechanism consists of two complementary Velcro strips located at either end of the attachment area. The second closure mechanism is located adjacent to the first closure mechanism and consists of complementary snaps which require greater force to both close and open.

The first closure mechanism is ideal for use by children, because the Velcro strips do not have to be closely aligned to achieve a satisfactory closure. The second closure mechanism is ideal for use in outdoor, high wind situations such as if used in stadiums, parades, and is essential for use in high speed activities such as skiing, ice skating, motor biking, or water skiing. The attachment mechanism of the present invention is provided to simplify the balloon mooring procedure. For example, one might want to attach helium balloons to a large number of name card holders at a party or convention. The person assigned to this task might find it difficult to select the correct name card as a guest arrives, and tie the balloon to the name card, repeatedly for large number of guests in a short amount of time. The present invention simplifies this process by allowing balloons and name cards to be prepared in advance and then easily connected. In the simplest embodiment the name card can be pinned onto one's garment and then a balloon attached by uniting the attachment area of the balloon ribbon with its complementary fastener on the name card.

Other embodiments are disclosed which include "portable" mooring objects that can be easily moved about and then released without being concerned that the attached balloon will float away.

OBJECTS AND ADVANTAGES

It is therefore an object of the present invention to provide an integrated mechanism for securely mooring a balloon to a solid object.

Another object of the present invention is to provide a name card holder which includes a mechanism for attachment to a balloon ribbon.

Yet another object of the present invention is to provide a system for detachably connecting a balloon to a portable mooring device.

Further objects, features and advantages of the present invention will become apparent upon reading and understanding this specification, taken in conjunction with the accompanying drawings.

FIGS. *7a*, *7b* and *7c* show cross-section views of various portable mooring devices which can be used in combination with other embodiments as a balloon mooring system.

DETAILED DESCRIPTION OF THE DRAWINGS

Figure 1:
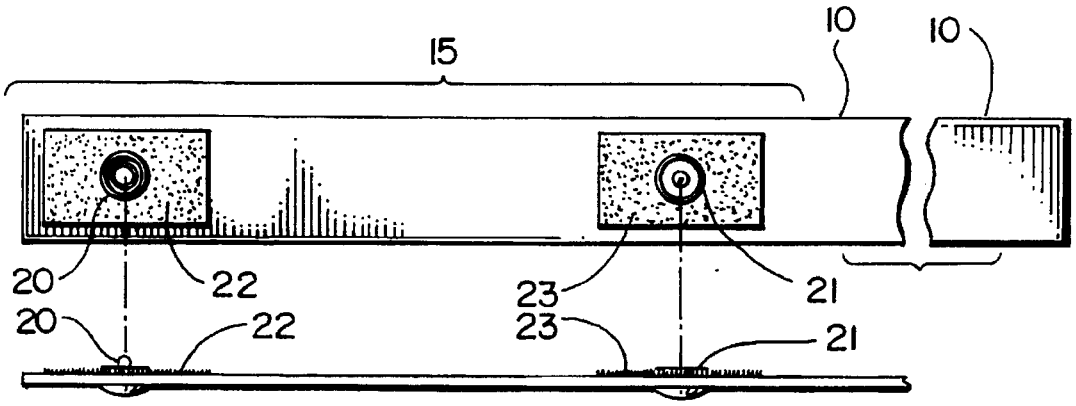
FIG. 1 shows a top and side view of the present invention.

Referring now in greater detail to the drawings, in which like numerals refer to like components throughout the several views, FIG. 1 depicts the preferred embodiment of the present invention, including ribbon 10 with anchoring area 15. Mounted on attachment area 15 are snap 21, snap fastener 20, Velcro hook patch 22, and complementary Velcro loop patch 23. It should be noted that although the term "ribbon" is used throughout this specification, other flexible materials, such as tapes or strings could be substituted.

The preferred embodiment of FIG. 1 has snap 21 and snap fastener 20 mounted to ribbon attachment area 15 of ribbon 10 at the same position as Velcro hook patch 22 and complementary Velcro loop patch 23. In this embodiment the Velcro patches 22 and 23 are glued to ribbon 10, but other Velcro attachment methods, such as sewing, are contemplated. Similarly, other materials can be substituted as attachment means in place of the present Velcro patches. For example, magnets could be used, as well as adhesive patches.

Figure 2:
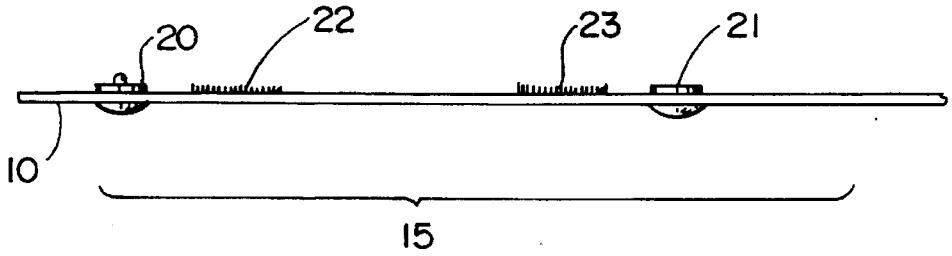
FIG. 2 shows a side view of an alternate embodiment of the invention.
Figure 3:
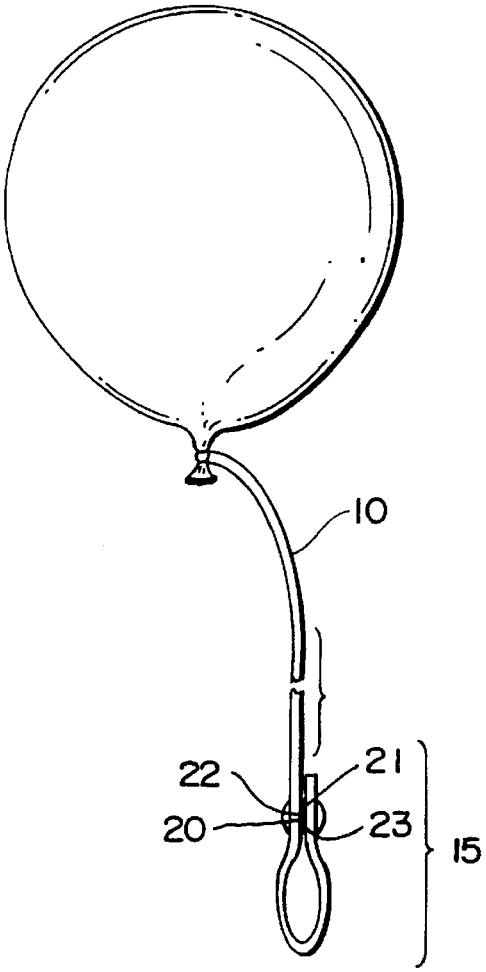
FIG. 3 shows the invention of FIG. 1 attached to a balloon.

The embodiment of FIG. 2 shows an alternate mounting position with Velcro patches 22 and 23 located beside snap 21 and snap fastener 20. FIG. 3 shows the preferred embodiment of FIG. 1 with snap 21 attached to snap fastener 20 and with Velcro hook patch 22 attached to Velcro loop patch 23; this forms a loop out of attachment area 15 which can be used to attach the ribbon 10 and consequently balloon 30 to a fixed object.

Figure 4:
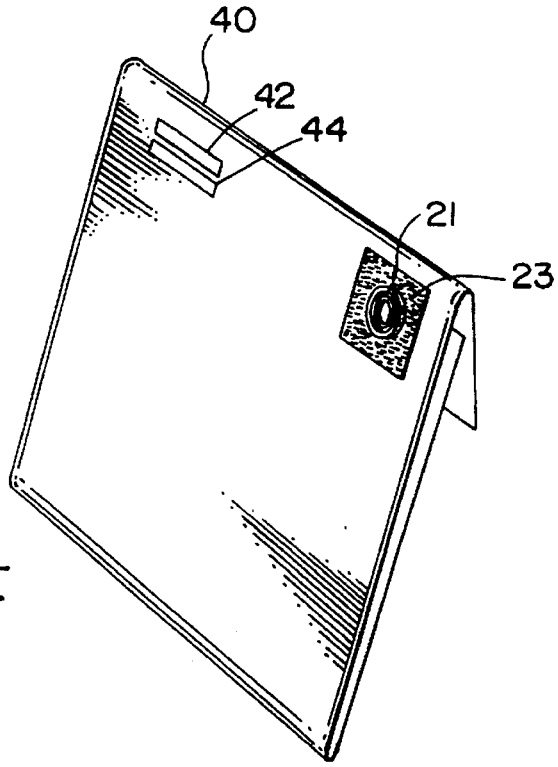
FIG. 4 shows an embodiment of the invention in combination with a name card holder.

FIG. 4 shows a name card holder 40, preferably made of clear acrylic, which comprises pad of an alternate embodiment of the present invention. This name card holder 40 as shown includes a Velcro loop 23 and a snap 21 for attachment to the attachment area 15 of balloon ribbon 10. Alternate or additional attachment provisions include two parallel slots 42, 44 cut in one side of the card holder 40. This configuration could be used by threading the ribbon anchoring end 15 through slot 42 and back out slot 44 to form a loop (see FIG. 3). Similar embodiments of this card holder 40 could include only Velcro or snap depending on the type of ribbon to be used.

In the embodiment of FIG. 4 a name card holder 40 is shown but other anchoring objects are contemplated and can easily be substituted without departing from the spirit of the invention. For example, articles of clothing, including swimsuits and head/wrist bands, stuffed toys, furniture, and signs such as those used by real estate companies could be substituted as alternate embodiment anchoring objects without departing from the spirit of the invention. All that would be required would be to manufacture the anchoring object in question to include an appropriately placed attachment means so it could be used with a matching balloon ribbon 10.

Figure 5:
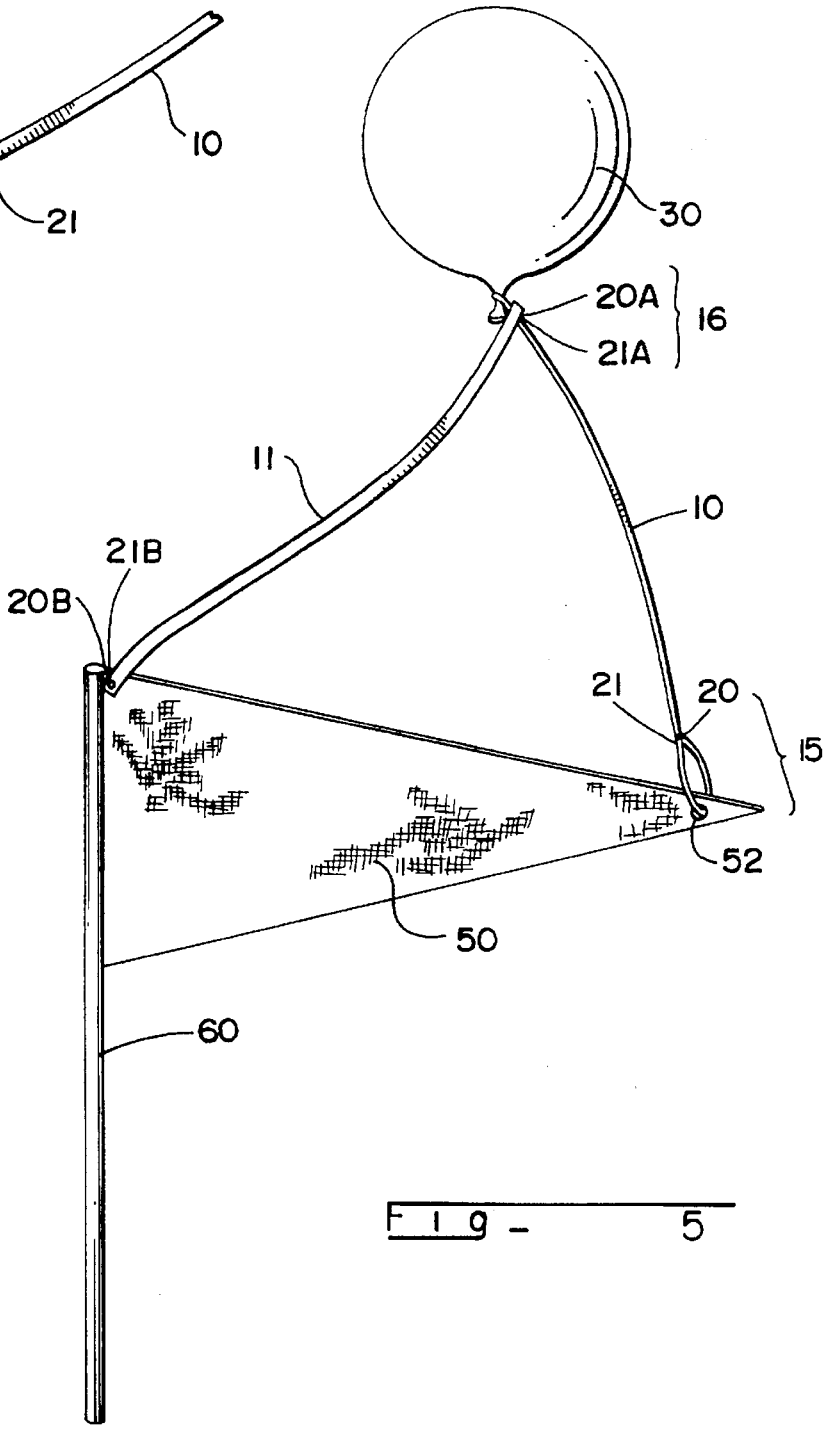
FIG. 5 shows an embodiment of the present invention in combination with a flag.
Figure 7A:
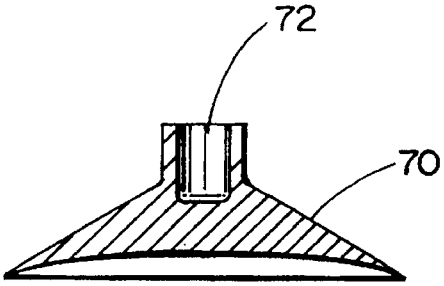
Figure 7B:
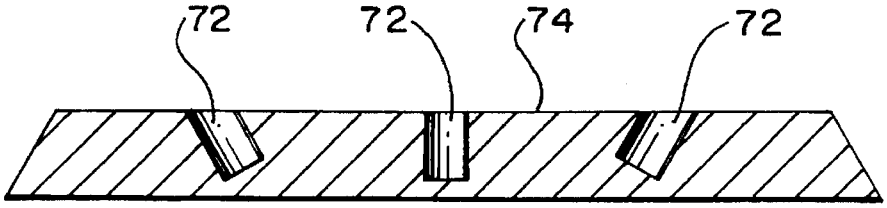
Figure 7C:
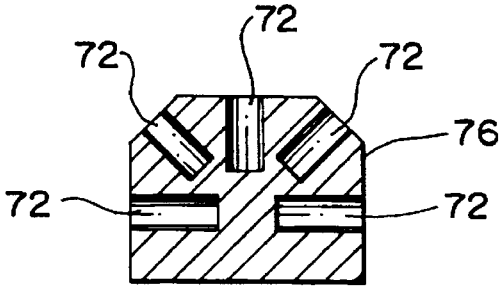

FIG. 5 shows an alternate embodiment including a flag 50 and a control ribbon 11, and which is designed to attach a balloon 30 to a flag 50 in a decorative and functional manner. The balloon 30 serves a dual purpose, both to support the flag in an erect position when there is no wind, and to add a decorative element. In this embodiment, ribbon 10 includes attachment area 15 at one end and also includes attachment means 16 at the opposite end of the ribbon. This is shown in FIG. 5 as a snap fastener 20A, which is attached to snap 21A at one end of control ribbon 11. The opposite end of control ribbon 11 also includes a snap 21B. The flag 50 is attached to pole 60 and includes a grommet 52 at the free end of the flag and a snap fastener 20B attached near the top of the flag near the pole. Control ribbon snap 21B is attached to snap fastener 20B on the flag 50 at one end and to ribbon 10 at the opposite end. Ribbon 10 is also attached to the flag by looping attachment area 15 through grommet 52.

Figure 6:
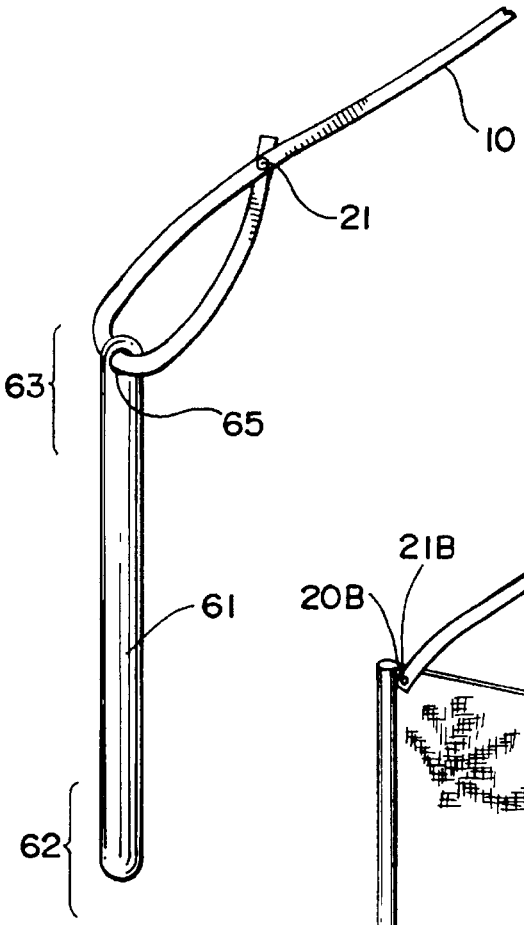
FIG. 6 shows an embodiment of the present invention in combination with a baton.

FIG. 6 shows another embodiment of the present invention which also includes a baton 61 which serves as a mooring object for the preferred embodiment. The baton 61 has a first end 62 and a second end 63 which includes an eyelet 65. The attachment area 15 of ribbon 10 can be looped through eyelet 65 as shown and then secured with snap 21 and snap fastener 20 (not shown) and/or complementary Velcro patches 22 and 23. The baton 61 preferably has a circular cross section with a diameter of at least ½ inch, and first and second ends 62 and 63 are rounded for safety.

Yet other embodiments are shown in FIGS. *7a*, *7b* and *7c* which respectively depict mooring objects including a suction cup 70 and blocks 74 and 76 in cross section. The suction cup 70 is preferably constructed of a resilient rubber material, includes pocket 72 and is suitable for attachment to any smooth, flat, non-porous surface. The pocket 72 of suction cup 70 can be configured to securely receive either baton 61 of FIG. 6 or the flag pole 60 of FIG. 5 so that they can be mounted to a vertical as well as a horizontal surface. Blocks 74 and 76 illustrate different configurations of solid mooring objects and pockets they include which can also be tailored to receive either baton 61 or flag pole 60. These blocks 74 and 76 can be either round, oval, or rectangular in outline and are preferably constructed of a dense solid material, such as metal or acrylic, which can be finished in a variety of decorative textures, depending on their intended use. For example, it can be polished metal or chrome, or can be black or clear acrylic with a gloss or matte surface. When combined with a collection of batons 61 or flag poles 60 and their attached balloons 30, these provide an attractive and festive display suitable for many occasions and uses.

Whereas the present invention has been described in detail with specific reference to particular embodiments thereof, it will be understood that variations and modifications can be effected within the spirit and scope of the present invention as herein before described and as defined in the appended claims.

I claim:

1. An apparatus for attaching a balloon to a name card holder, comprising a ribbon having a first end and a second end, said ribbon first end being reserved for attachment to the balloon and said ribbon second end including an anchoring area;

a standard name card holder, including, at least, means for attaching said name card holder to a garment or other object;

ribbon attachment means for attaching said ribbon second end to said name card holder, said ribbon attachment means being mounted to said ribbon anchoring area; and said name card holder further including ribbon connecting means for connecting to said ribbon attachment means.

2. Apparatus of claim 1, wherein said ribbon attachment means is comprised of, at least, two parts of a standard garment snap separated by a small span of ribbon and said card holder ribbon connecting means is comprised of two parallel slots in said card holder through which said ribbon attachment means can be threaded.

3. Apparatus of claim 1, wherein said ribbon attachment means is comprised of, at least, two complementary pieces of Velcro separated by a small span of ribbon and said card holder ribbon connecting means is comprised of two parallel slots in said card holder through which said ribbon attachment means can be threaded.

4. Apparatus of claim 1, wherein said ribbon attachment means is comprised of, at least, a piece of Velcro and said card holder ribbon connecting means is comprised of a complementary piece of Velcro.

5. An apparatus for attaching a balloon to a flag, comprising:

a ribbon having a first end and a second end, said ribbon first end being reserved for tying to the balloon and said ribbon second end including an anchoring area;

first attachment means mounted near said ribbon first end for attaching a control ribbon to said ribbon;

second attachment means for attaching said ribbon second end to said flag, said attachment means being mounted to said ribbon anchoring area;

said control ribbon including, at least, a first end and a second end, with third attachment means mounted to said control ribbon first end and fourth attachment means mounted to said control ribbon second end; and wherein said flag includes, at least, a top side, a bottom side, a first end for attachment to a flag pole, a second opposite end, and first flag attachment means for attachment to said ribbon second end, located near said flag second opposite end.

6. Apparatus of claim 5, wherein said flag further comprises a second flag attachment means for attachment to said control ribbon, located near the top side of said flag first end.

* * * * *